US009410698B2

(12) United States Patent
Mori

(10) Patent No.: US 9,410,698 B2
(45) Date of Patent: Aug. 9, 2016

(54) TUBULAR BURNER

(75) Inventor: Keisuke Mori, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 553 days.

(21) Appl. No.: 13/270,369

(22) Filed: Oct. 11, 2011

(65) Prior Publication Data

US 2013/0089826 A1 Apr. 11, 2013

(51) Int. Cl.
*F23D 14/08* (2006.01)
*F23D 14/26* (2006.01)

(52) U.S. Cl.
CPC ..... *F23D 14/08* (2013.01); *F23D 14/26* (2013.01); *F23D 14/085* (2013.01)

(58) Field of Classification Search
CPC ..... F23D 14/08; F23D 14/26; F23D 14/085
USPC ..... 431/354, 355
See application file for complete search history.

(56) References Cited

U.S. PATENT DOCUMENTS

| | | | | | |
|---|---|---|---|---|---|
| 431,716 | A | * | 7/1890 | Canfield | 431/354 |
| 790,714 | A | * | 5/1905 | Bray | 239/553.5 |
| 1,163,650 | A | * | 12/1915 | Fogler | 110/264 |
| 1,179,781 | A | * | 4/1916 | Varnum | 431/330 |
| 1,354,295 | A | * | 9/1920 | Hamilton | 239/432 |
| 1,908,135 | A | * | 5/1933 | Forster | 239/432 |
| 2,365,945 | A | * | 12/1944 | Ferguson | 239/425.5 |
| 2,901,032 | A | * | 8/1959 | Brola | 431/264 |
| 2,929,442 | A | * | 3/1960 | Brola | 431/262 |
| 3,074,469 | A | * | 1/1963 | Babbitt et al. | 431/285 |
| 3,156,292 | A | * | 11/1964 | Ross | 239/419.5 |
| 3,198,238 | A | * | 8/1965 | Hughes | 431/349 |
| 3,288,198 | A | * | 11/1966 | Hein et al. | 431/349 |
| 3,570,242 | A | * | 3/1971 | Leonardi | F23R 3/04 431/183 |
| 3,850,571 | A | * | 11/1974 | Zink et al. | 431/349 |
| 4,846,716 | A | * | 7/1989 | Courrege | 431/263 |
| 5,049,066 | A | * | 9/1991 | Kaiya et al. | 431/352 |
| 5,186,620 | A | * | 2/1993 | Hollingshead | F23D 14/045 239/558 |
| RE34,541 | E | * | 2/1994 | Kreiger | 431/1 |
| 5,433,602 | A | * | 7/1995 | Sigler | 431/286 |

(Continued)

FOREIGN PATENT DOCUMENTS

| | | | |
|---|---|---|---|
| JP | 57-127122 | U | 8/1982 |
| JP | 62-106212 | A | 5/1987 |

OTHER PUBLICATIONS

Office Action from Japanese Patent App. No. 2010-176153 (Feb. 18, 2014).

*Primary Examiner* — Avinash Savani
*Assistant Examiner* — Aaron Heyamoto
(74) *Attorney, Agent, or Firm* — Cermak Nakajima & McGowan LLP; Tomoko Nakajima

(57) ABSTRACT

A tubular burner includes a mixing tube and a flame hole member having a plurality of flame holes. The flame hole member is made of a sheet metal plate and has: a circular disk part having the plurality of flame holes formed therein; and a fitting tubular member which is elongated backward from a periphery of the circular disk part and is adapted to be fitted into an inner circumference at the front end region of the mixing tube. A clearance-generating section is formed at a front of the fitting tubular member so as to generate an annular clearance between the clearance-generating section and the inner circumference at the front end region of the mixing tube. A plurality of flame retention holes are formed in the clearance-generating section at a circumferential distance from one another.

5 Claims, 4 Drawing Sheets

(56) References Cited

U.S. PATENT DOCUMENTS

| | | | | |
|---|---|---|---|---|
| 5,562,440 | A * | 10/1996 | Rodgers | 431/328 |
| 6,036,481 | A * | 3/2000 | Legutko et al. | 431/354 |
| 6,168,422 | B1 * | 1/2001 | Motyka et al. | 431/202 |
| 6,619,280 | B1 * | 9/2003 | Zhou et al. | 126/39 R |
| 6,729,874 | B2 * | 5/2004 | Poe et al. | 431/354 |
| 6,951,454 | B2 * | 10/2005 | Sarv et al. | 431/9 |
| 7,204,688 | B2 * | 4/2007 | Han | 431/354 |
| 8,021,143 | B2 * | 9/2011 | Slaby | 431/12 |
| 2004/0018461 | A1 * | 1/2004 | Stephens et al. | 431/115 |
| 2004/0072113 | A1 * | 4/2004 | Chuan | 431/344 |
| 2004/0241601 | A1 * | 12/2004 | Spicer | 431/9 |
| 2009/0220899 | A1 * | 9/2009 | Spangelo et al. | 431/8 |
| 2010/0281872 | A1 * | 11/2010 | Hadley et al. | 60/748 |
| 2011/0076628 | A1 * | 3/2011 | Miura et al. | 431/12 |
| 2011/0179666 | A1 * | 7/2011 | Offredi | 34/201 |
| 2011/0183274 | A1 * | 7/2011 | Bahn | 431/2 |
| 2013/0252188 | A1 * | 9/2013 | Chen | 431/353 |

* cited by examiner

TUBULAR BURNER

BACKGROUND OF THE INVENTION

1. Technical Field

The present invention relates to a tubular burner which is provided with: a mixing tube having, at a rear end thereof, an inlet port into which a fuel gas and primary air flow; and a flame hole member which has a plurality of flame holes opening in the forward direction and which is adapted to be fitted into a front end region of the mixing tube.

2. Background Art

As this kind of burner, there is conventionally known one which is described in U.S. Pat. No. 5,186,620. In the burner as described therein, a flame hole member is made of a sintered metal of larger thickness. A plurality of flame holes which open in the forward direction are formed in the flame hole member so that a mixture of a fuel gas and primary air (hereinafter also referred to as air-gas mixture) is ejected from these flame holes for combustion.

In the above-mentioned conventional burner, a plurality of flame retention holes are formed around the periphery of the flame hole member at a circumferential distance from one another. Each of the flame retention holes is constituted by a groove that is formed in the peripheral surface of the flame hole member. By making smaller the groove depth at the rear portion of the groove, the velocity of ejection of the air-gas mixture out of the flame retention holes is lowered. As a result, the flame to be formed by the combustion of the air-gas mixture to be ejected from the flame retention holes becomes hard to be lifted off, thereby securing flame stability.

However, the above-mentioned conventional burner has a disadvantage in that the flame hole member is made of a sintered metal of higher material cost and, therefore, that the cost increases.

SUMMARY

Problems that the Invention is to Solve

In view of the above points, this invention has a problem of providing a tubular burner the flame hole member of which is made of an inexpensive sheet metal plate material, thereby reducing the cost and, at the same time, which is capable of securing a flame stability.

Means for Solving the Problems

In order to solve the above-mentioned problems, this invention provides a tubular burner comprising: a mixing tube having at a rear end thereof an inlet port into which a fuel gas and primary air flow; and a flame hole member having a plurality of flame holes which open forward. The flame hole member is adapted to be fitted into a front end region of the mixing tube such that a mixture of the fuel gas and primary air is ejected through the flame holes for combustion. The flame hole member is made of a sheet metal plate and has: a circular disk part having the plurality of flame holes formed therein so as to open forward; and a fitting tubular member which is elongated backward from a periphery of the circular disk part and is adapted to be fitted into an inner circumference at the front end region of the mixing tube. A clearance-generating section is formed at a front of the fitting tubular member so as to generate an annular clearance between the clearance-generating section and the inner circumference at the front end region of the mixing tube. A plurality of flame retention holes are formed in the clearance-generating section at a circumferential distance from one another so that the mixture of the fuel gas and primary air is ejected toward the inner circumference at the front end region of the mixing tube.

According to this invention, since the flame hole member is made of a sheet metal plate, the cost can be made smaller than the one in which a flame hole member made of sintered metal is used. Furthermore, according to this invention, although the flame hole member is made of a sheet metal plate, flame retention properties can be secured. In other words, according to this invention, the air-gas mixture ejected from each of the flame retention holes collides with the inner circumference at the front end region of the mixing tube, and is consequently diffused in the circumferential direction within the annular clearance that is generated between the clearance-generating section at the front of the fitting tubular member and the inner circumference at the front end region of the mixing tube, thereafter being ejected forward through this clearance. The velocity of ejection of the air-gas mixture from this clearance is lowered due to the collision of the air-gas mixture with the inner circumference at the front end region of the mixing tube and subsequent dispersion thereof. Therefore, there will be formed flames that are hard to be lifted off, thereby securing flame stability.

Preferably, a rounded corner section is formed at the front end region of the fitting tubular member. The rounded corner section is curved toward the circular disk part at a predetermined curvature so as to be away from the inner circumference at the front end region of the mixing tube. The rounded corner section constitutes the clearance-generating section to generate the clearance at the front end region of the mixing tube. In addition, preferably, a small-diameter cylindrical section is formed at the front end region of the fitting tubular member in a manner to be away from the inner circumference at the front end region of the mixing tube. The small-diameter cylindrical section constitutes the clearance-generating section to generate the annular clearance at the front end region of the mixing tube. Still furthermore, preferably, a tapered tube section is formed at the front end region of the fitting tubular member so as to be away from the inner circumference at the front end region of the mixing tube. The tapered tube section constitutes the clearance-generating section to generate the annular clearance at the front end region of the mixing tube.

DESCRIPTION OF PREFERRED EMBODIMENTS

Figure 1:
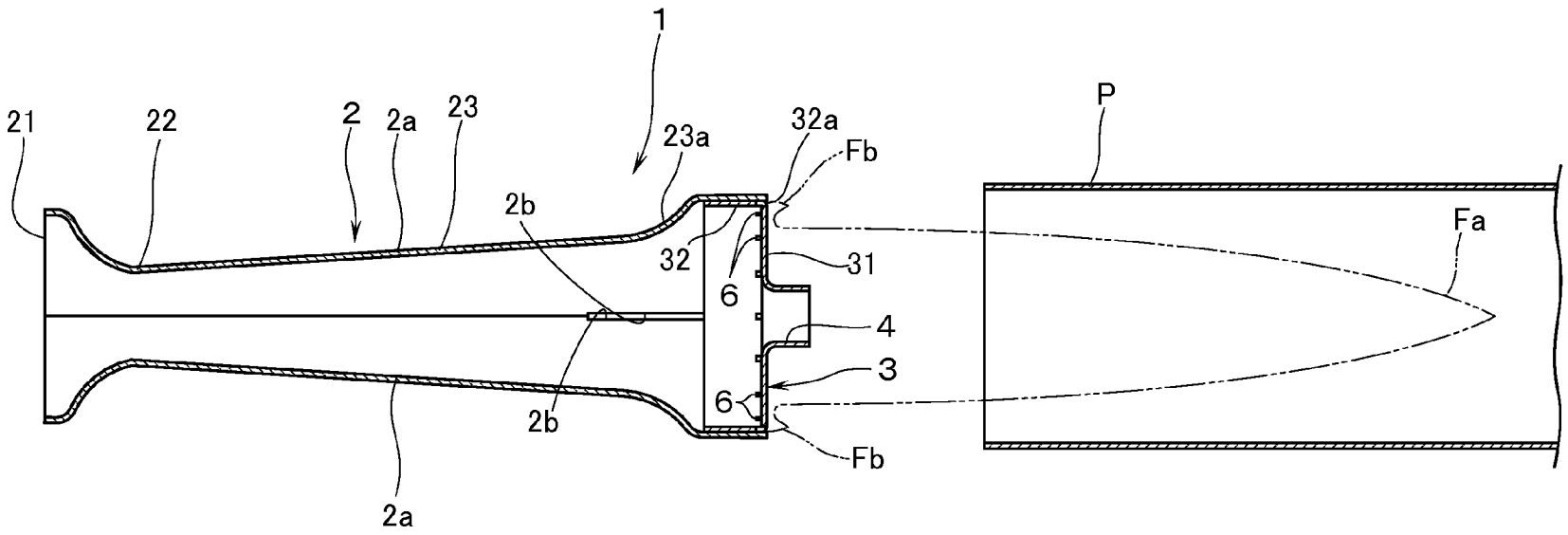
FIG. 1 is a sectional side view of a burner according to a first embodiment of this invention.

In FIG. 1 reference numeral 1 denotes a tubular burner according to an embodiment of this invention. This burner 1 is used as a heat source of a heating appliance, and is disposed so as to lie opposite to an inlet end of a heat exchange pipe P which performs heat exchanging with room air.

Figure 2:
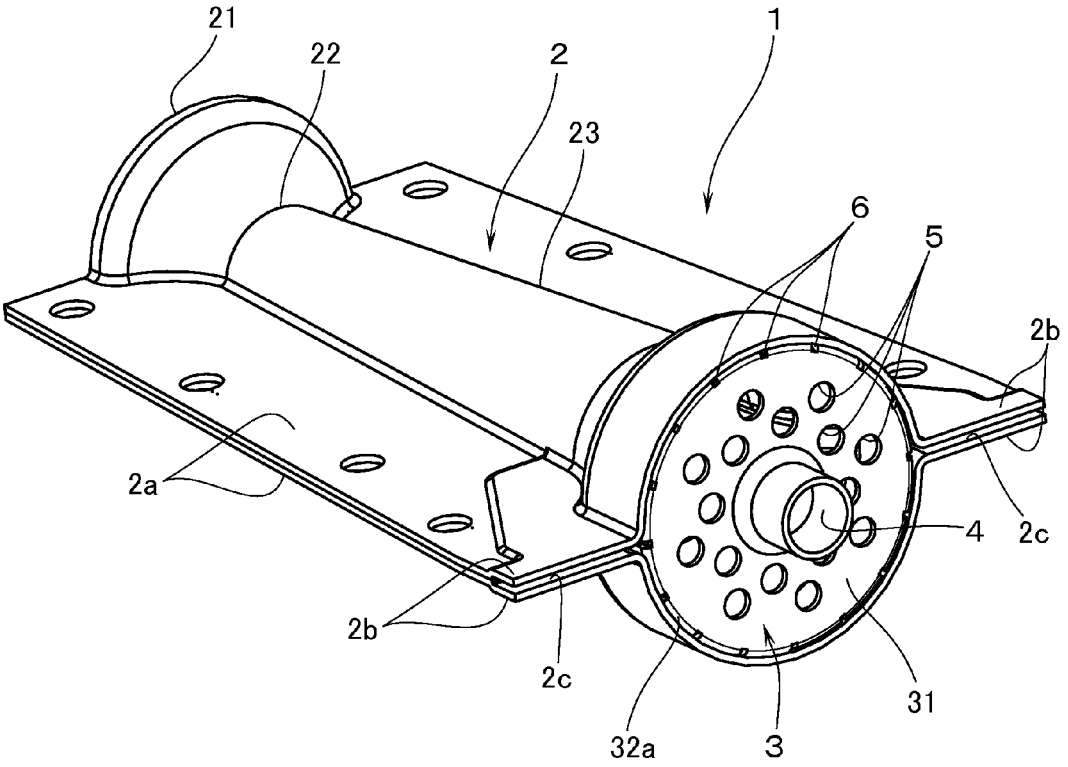
FIG. 2 is a perspective view of the burner according to the first embodiment of this invention.

The burner 1 is made up of a mixing tube 2, and a flame hole member 3 which is adapted to be fitted into a front end region of the mixing tube 2. Also with reference to FIG. 2, the mixing tube 2 has: an inlet port 21 at a rear end thereof; a venturi section 22 which is reduced in diameter relative to the inlet port 21; and a tapered tube section 23 which is gradually increased in diameter from the venturi section 22 forward. In this arrangement, a fuel gas ejected from a gas nozzle (not illustrated) which is disposed so as to face the inlet port 21, and primary air flow from the inlet port 21 into the mixing tube 2 so that air-gas mixture of the fuel gas and primary air is generated within the mixing tube 2. The mixing tube 2 is made of sheet metal plates, and is formed by combining together two sheet metal plates 2*a*, 2*a* made, e.g., of press-formed stainless steel, and the like.

Although not illustrated, a plurality of tubular burners 1 are disposed in parallel with one another. At the front end regions of the two sheet metal plates 2*a*, 2*a* that constitute the mixing tube 2, there are respectively formed dented parts 2*b* in a manner to be away from the other sheet metal plate 2*a*. The clearance to be generated between the two sheet metal plates 2*a*, 2*a* by means of these dented parts 2*b*, 2*b* constitute slit-shaped carry-over flame holes 2*c* which cause flames to be carried over to the adjoining burners.

The front end region of the mixing tube 2 is formed into a cylindrical shape in a manner to be elongated forward from an enlarged-diameter portion 23*a* of a curved shape at the front end of the tapered tube section 23. The flame hole member 3 is fitted into the part of this cylindrical shape. The flame hole member 3 is formed by a sheet metal plate of, e.g., stainless steel and the like. In this manner, by making the flame hole member 3 in a sheet metal plate, the manufacturing cost can be reduced as compared with the conventional case in which the flame hole member made of sintered metal is employed.

The flame hole member 3 has: a circular disk part 31 having formed therein a plurality of flame holes that open forward; and a fitting tubular member 32 which is elongated backward from the periphery of the circular disk part 31 so as to be fitted into an inner circumference at a front end region of the mixing tube 2. As the flame holes to open forward, the circular disk part 31 has: a first flame hole 4 in the central part thereof; and a plurality of second flame holes 5 of smaller diameter than the first flame hole 4, the second flame holes 5 being located around the periphery of the first flame hole 4. The first flame hole 4 is formed into a cylindrical shape that protrudes beyond the front face of the circular disk part 31.

By the way, if the flame hole member 3 is made of a sheet metal plate, the mixture of the fuel gas and the primary air is ejected with the directional components of the radially outward direction under the influence of the tapered tube section 23, whereby the flames get easily spread radially outward. On the other hand, by making an arrangement as mentioned above such that the first flame hole 4 is formed into the cylindrical shape, the flow of the air-gas mixture that is ejected from the first flame hole 4 is rectified so as to be directed forward. As a result of combustion of this air-gas mixture, there will be formed a central flame that is largely elongated forward. In this manner, the flow velocity of the central flame becomes larger than the flow velocity of the peripheral flames that are formed by the combustion of the air-gas mixture that issues from the second flame holes 5 of smaller diameter than that of the first flame hole 4. Due to Bernoulli law, the peripheral flames are attracted toward the central flame. As a result, as shown in FIG. 1, the peripheral flames will be integrated or combined into the central flame so as to form an aggregated flame Fa that is narrowly elongated forward, thereby preventing the flames from getting spread in the radially outward direction.

In addition, at the front of the fitting tubular member 32 of the flame hole member 3, there is formed a rounded corner section 32*a* which is curved at a predetermined curvature toward the circular disk part 31 in a manner to be away from the inner circumference at the front end region of the mixing tube 2 (this rounded corner section is generically referred to as "a clearance-generating section"). In the rounded corner section 32*a*, there are formed a plurality of flame retention holes 6 of a slit shape at a circumferential distance from one another.

Figure 3:
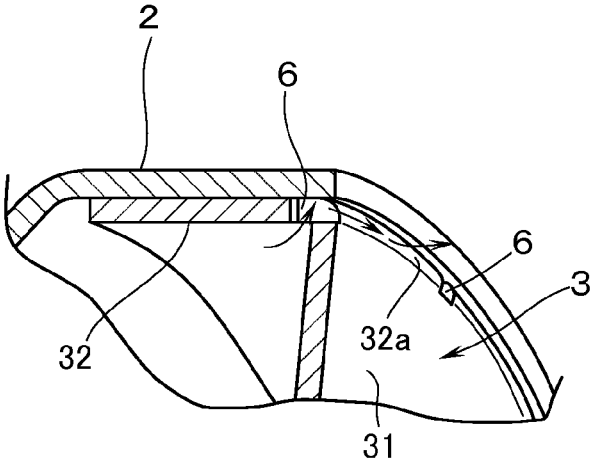
FIG. 3 is an enlarged sectional view of an essential part of the burner according to the first embodiment of this invention.

The air-gas mixture to be ejected from each of the flame retention holes 6 strikes or collides, as shown in FIG. 3, with the inner circumference at the front part of the mixing tube 2, and is diffused in the circumferential direction within an annular clearance that is formed between the above-mentioned rounded corner section 32*a* and the inner circumference at the front end region of the mixing tube 2. The air-gas mixture is thereafter ejected forward through this clearance. The velocity of the air-gas mixture to be ejected through this clearance lowers due to the collision of the air-gas mixture with the inner circumference at the front end region of the mixing tube 2. Therefore, flames Fb that are hard to be lifted off can be formed to thereby secure flame stability.

If the total area of the flame retention holes 6 becomes too large, there will be generated a red heat at the front end region of the mixing tube 2, resulting in deterioration of durability. It is therefore necessary to keep the total area of the flame retention holes 6 below a certain amount. For example, suppose that the rated burning capacity of the burner 1 is 3500 kcal/h, that the diameter of the inner circumference at the front end region of the mixing tube 2 is 32 mm, and that the radius of curvature of the rounded corner section 32*a* is 1-1.5 mm. Then it is preferable to form about 16 flame retention holes at a circumferentially equal distance from one another so that the total area of the flame retention holes 6 becomes about 0.3% (about 10 kcal/h) of the total area of the first and second flame holes 4, 5.

Figure 4:
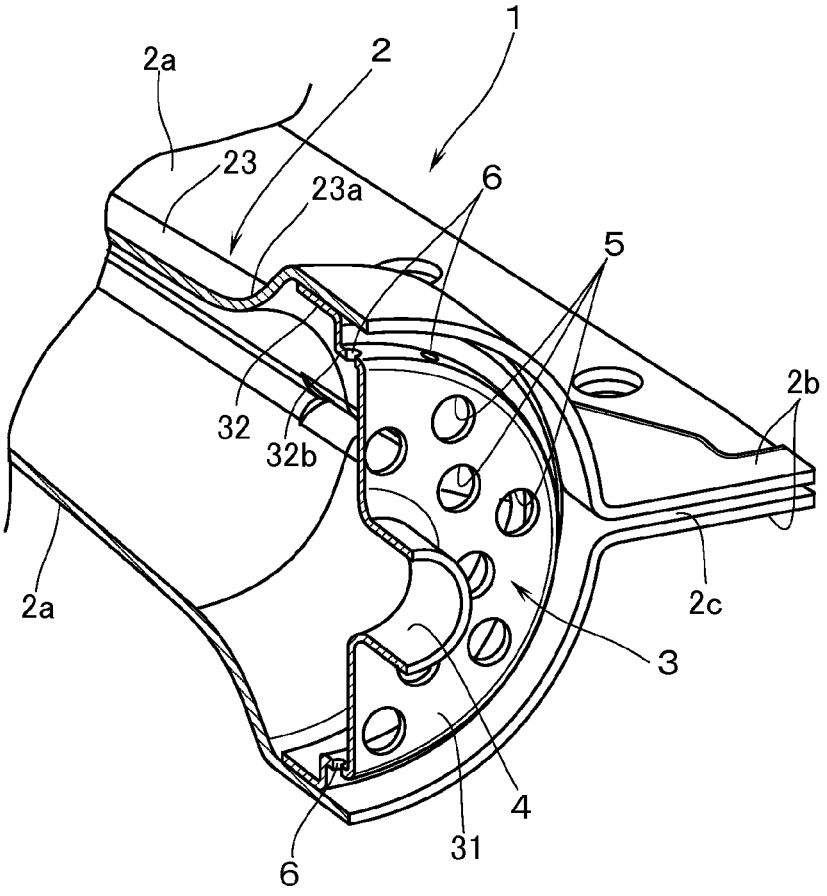
FIG. 4 is an enlarged perspective view, partly shown in section, of an essential part of a burner according to a second embodiment of this invention.

A description will now be made of a second embodiment as shown in FIG. 4. The basic construction of the second embodiment is the same as that of the first embodiment, and the same reference numerals are affixed to the elements and members that are similar to those of the first embodiment.

The difference of the second embodiment from the first embodiment is that, in place of the rounded corner section 32*a* of the first embodiment, there is formed a small-diameter cylindrical section 32*b* which is away from the inner circumference at the front end region of the mixing tube 2, and that a plurality of flame retention holes 6 are formed in the small-diameter cylindrical section 32*b* at a circumferential distance from one another (this small-diameter cylindrical section is generically referred to as "a clearance-generating section").

Also in the second embodiment, the air-gas mixture to be ejected from each of the flame retention holes 6 collides against the inner circumference at the front end region of the mixing tube 2, and is diffused in the circumferential direction within the annular clearance that is formed between the small-diameter cylindrical section 32*b* and the inner circumference at the front end region of the mixing tube 2. Therefore, the velocity of the air-gas mixture to be ejected through this clearance forward is kept low, and the flames that are hard to be lifted off can be formed, thereby securing flame stability.

Figure 5:
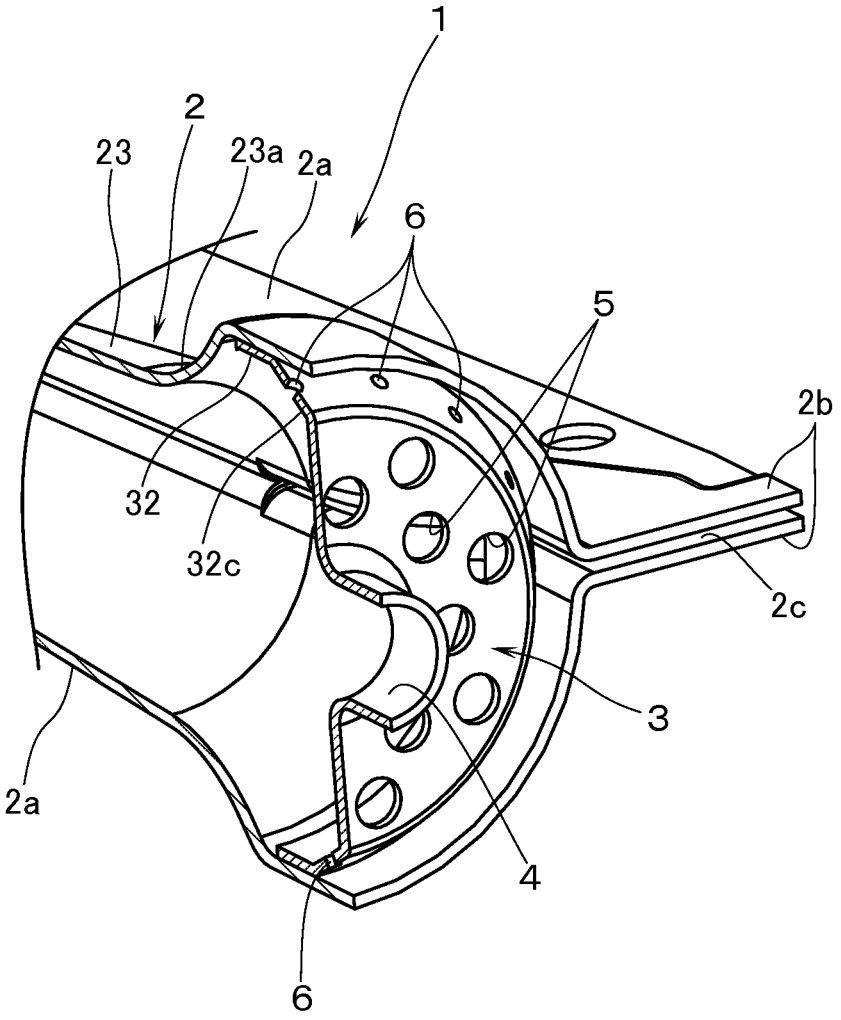
FIG. 5 is an enlarged perspective view, partly shown in section, of an essential part of a burner according to a third embodiment of this invention.

Further, in the second embodiment, the small-diameter cylindrical section 32*b* is formed at the front section of the fitting tubular member 32. Alternatively, as in the third embodiment illustrated in FIG. 5, there may be formed, at a front section of the fitting tubular member 32, a tapered cylindrical section 32*c* which is gradually reduced in diameter in the front direction so as to be away from the inner circumference at the front end region of the mixing tube 2. Then, in the third embodiment, a plurality of flame retention holes 6 are formed in the tapered tube section 32*c* at a circumferential distance from one another (this tapered cylindrical section is generically referred to as "a clearance-generating section").

Also in the third embodiment, the air-gas mixture to be ejected from each of the flame retention holes 6 collides with the inner circumference at the front end region of the mixing tube 2, and is diffused in the circumferential direction within the annular clearance that is formed between the tapered cylindrical section 32*c* and the inner circumference at the front end region of the mixing tube 2. Therefore, the velocity of the air-gas mixture to be ejected through this clearance forward can be kept low, and flames that are hard to be lifted off can be formed, thereby securing flame stability.

Descriptions have so far been made of embodiments of this invention with reference to the accompanying drawings. This invention is, however, not limited to the above-mentioned embodiments. For example, in the above-mentioned embodiments, there was used a mixing pipe 2 made of sheet metal plates. It is, however, possible to use a mixing tube made of casting. Further, in the above-mentioned embodiments, this invention was applied to a tubular burner for heating appliances. This invention can, however, be applied to tubular burners which are used in combustion equipment other than a heating appliance.

What is claimed is:

1. A tubular burner comprising:

a mixing tube having at a rear end thereof an inlet port into which a fuel gas and primary air flow; and a flame hole member having a plurality of flame holes which open forward, the flame hole member being adapted to be fitted into a front end region of the mixing tube such that a mixture of the fuel gas and primary air is ejected through the flame holes for combustion, wherein the flame hole member is made of a sheet metal plate and has:

a circular disk part having the plurality of flame holes formed therein and a center flame hole formed into a cylindrical shape protruding perpendicularly and extending directly from the circular disk so as to open forward;

and a fitting tubular member which is elongated backward from a periphery of the circular disk part and is adapted to be fitted into an inner circumference at the front end region of the mixing tube, wherein a clearance-generating section is formed at a front of the fitting tubular member so as to generate an annular clearance between the clearance-generating section and the inner circumference at the front end region of the mixing tube, an outer face of the clearance-generating section facing and spaced apart from the inner circumference at the front end region of the mixing tube, wherein a plurality of flame retention holes are formed in the clearance-generating section at a circumferential distance from one another so that the mixture of the fuel gas and primary air is ejected radially outward toward the inner circumference of the mixing tube, and wherein a front terminal face of the mixing tube is flush with the circular disk part.

2. The tubular burner according to claim 1, wherein a rounded corner section is formed at the front end region of the fitting tubular member, the rounded corner section being curved at a predetermined curvature toward the circular disk part so as to be away from the inner circumference at the front end region of the mixing tube, the rounded corner section constituting the clearance-generating section at the front of the fitting tubular member.

3. The tubular burner according to claim 1, wherein a small-diameter cylindrical section is formed at the front of the fitting tubular member so as to be away from the inner circumference at the front end region of the mixing tube, the small-diameter cylindrical section constituting the clearance-generating section at the front of the fitting tubular member.

4. The tubular burner according to claim 1, wherein a tapered tube section is formed at the front of the fitting tubular member so as to be away from the inner circumference at the front end region of the mixing tube, the tapered tube section constituting the clearance-generating section at the front of the fitting tubular member.

5. The tubular burner according to claim 1, wherein the plurality of flame retention holes is covered by the front end region of the mixing tube.

* * * * *